US005946996A

United States Patent [19]

Oussani, Jr. et al.

[11] Patent Number: 5,946,996

[45] Date of Patent: Sep. 7, 1999

[54] AUTOMATIC FEED CHADLESS ENVELOPE SLITTER

[75] Inventors: James J. Oussani, Jr.; Gregory B. Oussani, both of Brooklyn, N.Y.

[73] Assignee: The Staplex Company, Inc., Brooklyn, N.Y.

[21] Appl. No.: 09/001,708

[22] Filed: Dec. 31, 1997

[51] Int. Cl.[6] ..... B26D 7/00

[52] U.S. Cl. ..... 83/444; 83/446; 83/449; 83/450; 83/912; 83/425; 83/436.3; 83/436.75

[58] Field of Search ..... 83/444, 446, 447, 83/449, 450, 879, 886, 887, 869, 425, 426, 436.3, 436.6, 436.7, 436.75, 912; D08/61, 102; 53/381.4, 381.3; 271/121, 124, 251, 250

[56] References Cited

U.S. PATENT DOCUMENTS

| | | | |
|---|---|---|---|
| D. 260,133 | 8/1981 | Power et al. | 83/912 X |
| D. 272,229 | 1/1984 | Oussani | 83/912 X |
| 3,381,564 | 5/1968 | Whiteford | 83/912 X |
| 3,907,298 | 9/1975 | Irvine et al. | 271/122 X |
| 3,943,807 | 3/1976 | Bingham et al. | 83/425 X |
| 4,419,915 | 12/1983 | Oussani | 83/912 X |
| 4,426,037 | 1/1984 | Mizuma | 271/251 X |
| 4,728,095 | 3/1988 | Irvine et al. | 271/124 X |
| 4,744,554 | 5/1988 | Kulpa et al. | 271/251 |
| 4,775,143 | 10/1988 | Arnoldi et al. | 271/251 |
| 4,831,273 | 5/1989 | Ross et al. | 250/561 X |
| 4,930,764 | 6/1990 | Holbrook et al. | 271/119 X |
| 5,088,718 | 2/1992 | Stephan et al. | 271/121 X |
| 5,154,108 | 10/1992 | Stepan et al. | 271/121 X |
| 5,156,515 | 10/1992 | Charron et al. | 83/912 X |
| 5,163,668 | 11/1992 | Winship et al. | 271/124 X |
| 5,261,652 | 11/1993 | Kubo | 271/121 X |
| 5,269,505 | 12/1993 | Sardano | 271/121 X |
| 5,295,675 | 3/1994 | Hain | 271/121 X |
| 5,316,288 | 5/1994 | Fish et al. | 271/250 X |
| 5,465,954 | 10/1996 | Takemoto et al. | 271/251 X |
| 5,564,544 | 10/1996 | Takemoto et al. | 271/251 X |
| 5,601,282 | 2/1997 | Milo et al. | 271/121 X |
| 5,711,518 | 1/1998 | Portaro et al. | 271/121 X |
| 5,718,425 | 2/1998 | Veigl | 271/121 |
| 5,765,452 | 6/1998 | Yankloski | 177/25.11 X |
| 5,769,411 | 6/1998 | Nakagawa et al. | 271/121 X |

*Primary Examiner*—M. Rachuba
*Attorney, Agent, or Firm*—Paul J. Sutton

[57] ABSTRACT

A beltless automatic feed chadless envelope slitter device is disclosed. A separator-alignment assembly assures that only the lowermost envelope received from an infeed zone is passed downstream to a slitter and the envelope so-passed has its marginal edge aligned with a guide fence. The separator-alignment assembly is comprised of a pair of drive wheels having upper peripheral portions projecting above the table in combination with a pair of drag levers having high friction portions at the lowermost ends thereof. The high friction portions are preferably spring urged toward the table, and are shiftable upwardly and downwardly to accommodate envelopes of varying thickness and envelopes which themselves include varying thickness portions. The high friction components are urged toward the table at positions laterally offset from the peripheries of the drive wheels. Preferably, the drive wheels rotate about an axis inclined to define an included angle in a downstream direction with a guide fence of less than 90 degrees whereby the conjoint action of the drag means and peripheral portions urges the envelope passing over the peripheral portions in a direction laterally toward the guide fence. Optionally, the slitter may incorporate a modular precision slitting element whereby the entire slitter components may be interchanged.

3 Claims, 7 Drawing Sheets

AUTOMATIC FEED CHADLESS ENVELOPE SLITTER

BACKGROUND OF THE INVENTION

The present invention is directed to an envelope slitting device and relates more particularly to a device which will automatically feed envelopes at an infeed zone or station to a final slitting station wherein a slit is formed in the envelope adjacent a longitudinal margin thereof. The slitting device will be hereinafter referred to as a chadless slitter, since the slitting action is effected without separating increments of the envelope (chad) from the body of the envelope.

The invention is directed more particularly to an externally beltless feed device capable of precision slitting envelopes of various sizes, including envelopes wherein portions of the respective envelope are of different thickness.

The invention is further directed to a device of the type described incorporating a novel separator-alignment station for receiving envelopes from the infeed zone, aligning them against a guide fence and blocking all but the lowermost envelope in the stack from proceeding through the device to the slitting station.

PRIOR ART

Reference is made to U.S. Pat. No. 4,419,915 and the patents cited therein. The noted patent, which is owned by the applicant herein, is directed to a commercially successful envelope slitting device which, like the device of the instant application, forms a cut or slit through a main face of the envelope adjacent a margin thereof without totally removing any portion of the envelope from the main body thereof. The advantages of this type of envelope opener are set out in detail in the above referenced patent and include the fact that the contents of the envelope are safeguarded from loss, since the components of the slit envelope continue to encompass the entirety of the contents of the envelope.

While it is known to provide various types of belt feeds, devices employing this feeding mode are inherently dangerous in that it is always possible that the hair or fingers of an operator or the clothing of the operator may be drawn into the device.

SUMMARY OF THE INVENTION

The present invention may be summarized as directed to an automatic envelope slitter device employing a precision chadless slitter assembly characterized in that envelopes at an infeed station are automatically advanced one at a time from a stack, the envelopes being fed through a separator-alignment station which functions both to assure that only one envelope is advanced to the slitter station and also to assure that the advanced envelope is precisely located laterally against a guide fence, so that the slitting action is always effected at a precisely defined location adjacent a longitudinal margin of the envelope.

It is accordingly an object of the invention to provide a slitter device which will automatically remove the lowermost envelope of a stack at an infeed station, and align the envelope precisely relative to a chadless cutting station.

A still further object of the invention is to provide a feeder device of the type described which is adapted to remove and feed seriatim, the lowermost envelope of a stack notwithstanding the stack is comprised of envelopes of different thickness.

A further object of the invention is the provision of a device of the type described capable of processing envelopes which are thicker in one portion than in another.

A still further object of the invention is the provision of the type described which incorporates a modular chadless cutting station whereby a given station may be readily removed and a substituted station inserted.

DETAILED DESCRIPTION OF THE DRAWINGS

Figure 1:
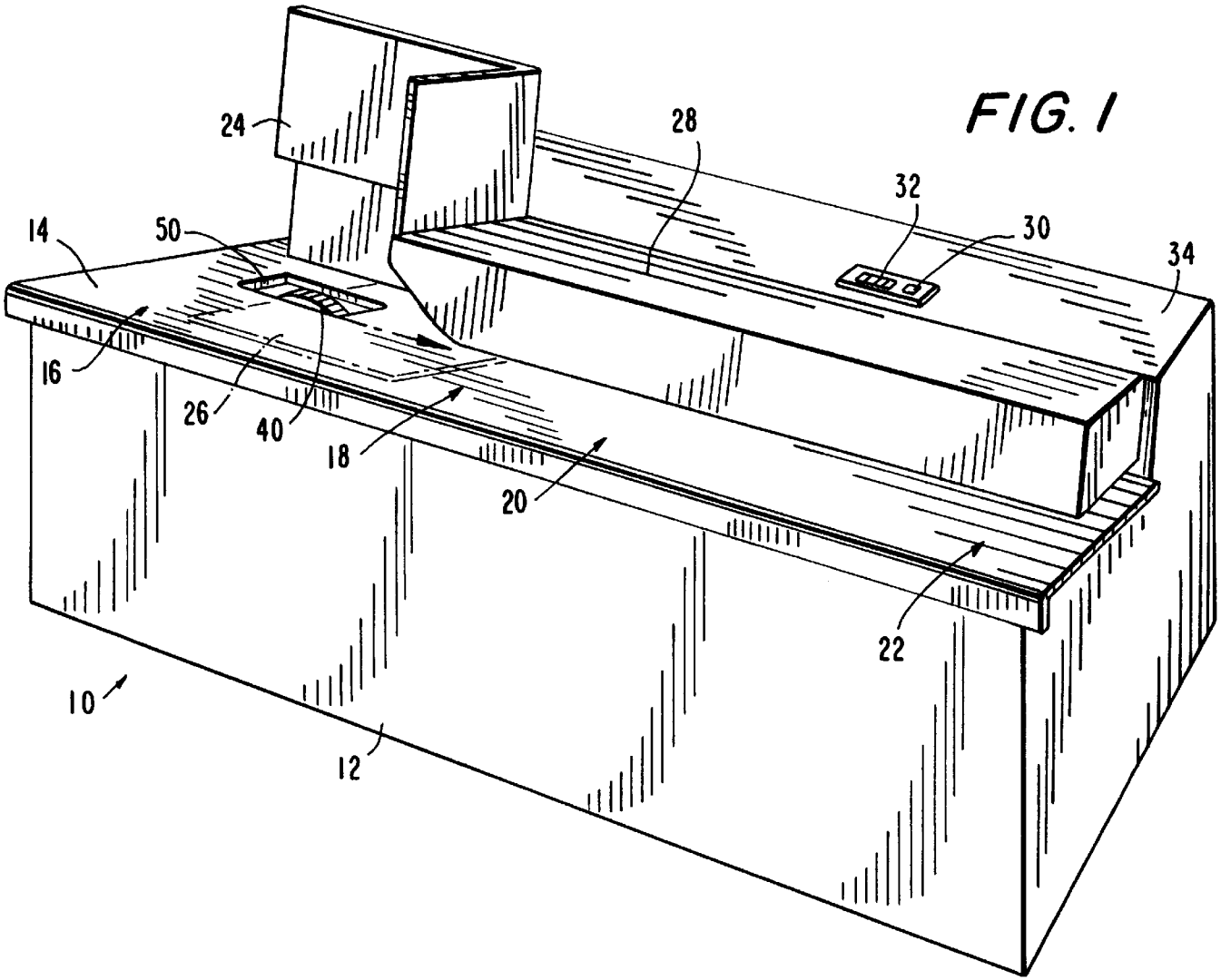
FIG. 1 is a perspective of the automatic mail opener.

As best seen in FIG. 1, the automatic electric opener 10 is comprised of a support structure in an open style cantilever system designed for easy access and service. The lower housing 12 supports an upper cantilever plate or table 14, which is longitudinally extended, providing an infeed zone 16, a separating and aligning zone 19 leading to guide zone 20 and precision chadless slitting zone 22.

Preferably, the table 14 is inclined toward a guide plate or fence 15 to gravitationally assist alignment of the envelopes in a manner which will become apparent hereinafter. The inclination is small in the order of 10 to 15 degrees and hence the table is hereinafter referred to as generally horizontal.

Upper guide plate 24 at the infeed station facilitates proper introduction of an envelope 26 to be placed on plate 14 and proceed throughout its guided path until it exits the unit 10 with one edge precisely slit. It will be understood that the envelope 26 represents the lowest of a stack (not shown) of envelopes disposed at the infeed zone 16.

An upper hood 28 acts as a safety to protect against accidental introduction of hair, fingers or items of clothing into contact with moving parts.

The device may include an on-off switch 30 and a read-out 32 of an electronic counter indicating the number of envelopes processed, these parts being conveniently located on upper frame 34 of the unit 10.

Figure 2:
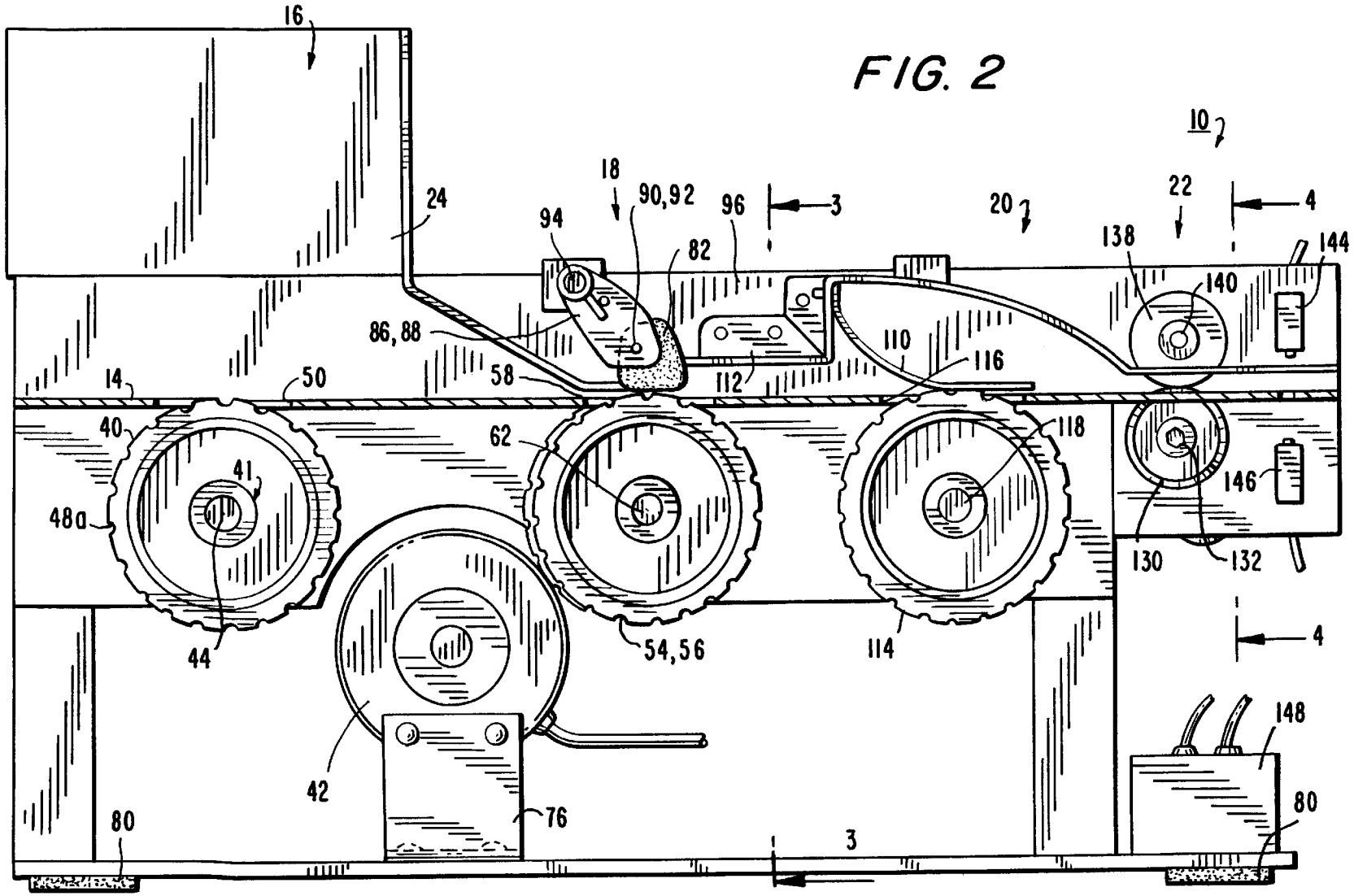
FIG. 2 is a front elevational view thereof with the outer housing removed.

In FIG. 2 there is shown the front of the unit 10 with a portion of the housing 12 and hood 28 removed to facilitate an understanding of the operation of the device. As will be apparent, the device incorporates a totally beltless feed thereby eliminating wear and safety hazard problems.

Infeed of the lowermost envelope from the stack is effected via a feed tire 40, driven by motor 42 via shaft 44 and timing belt 46 (FIG. 5), surrounding a pulley 48 journaled on shaft 44. The feed tire 40 has grooves 48*a* on its outer periphery so as to engage the under surface of envelope or package 26, the periphery of the tire protruding through a cut-out 50 in plate 14. Drive of the tire 40 is effected through a clutch overdrive mechanism 41 (operated by a compression spring not shown) so that the tire will stall if subjected to undesirably high drag forces, thereby acting as a safety clutch.

Figure 3:
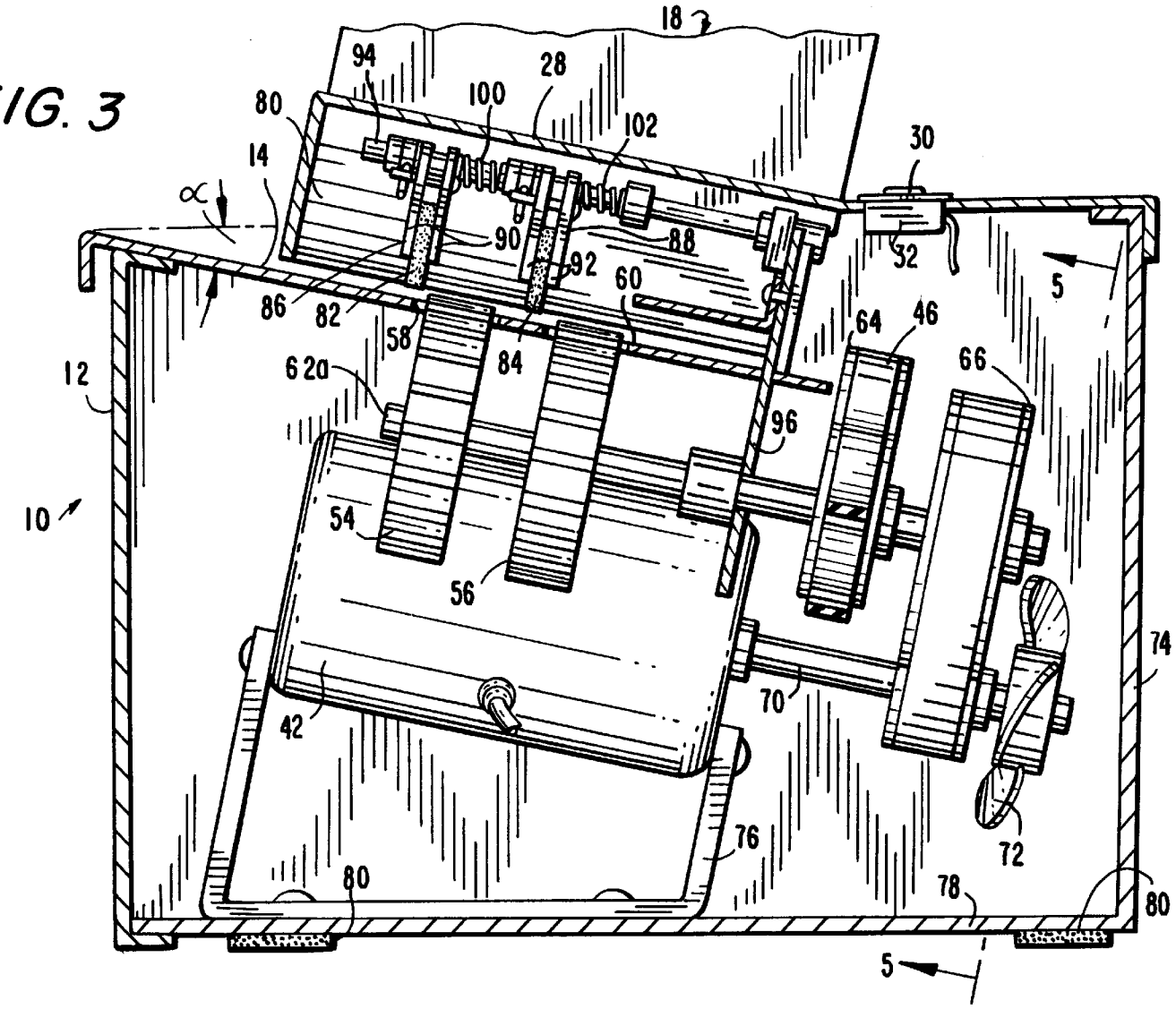
FIG. 3 is a cross-sectional view taken along the lines 3—3 of FIG. 2, showing the feed tire and separating station.
Figure 4:
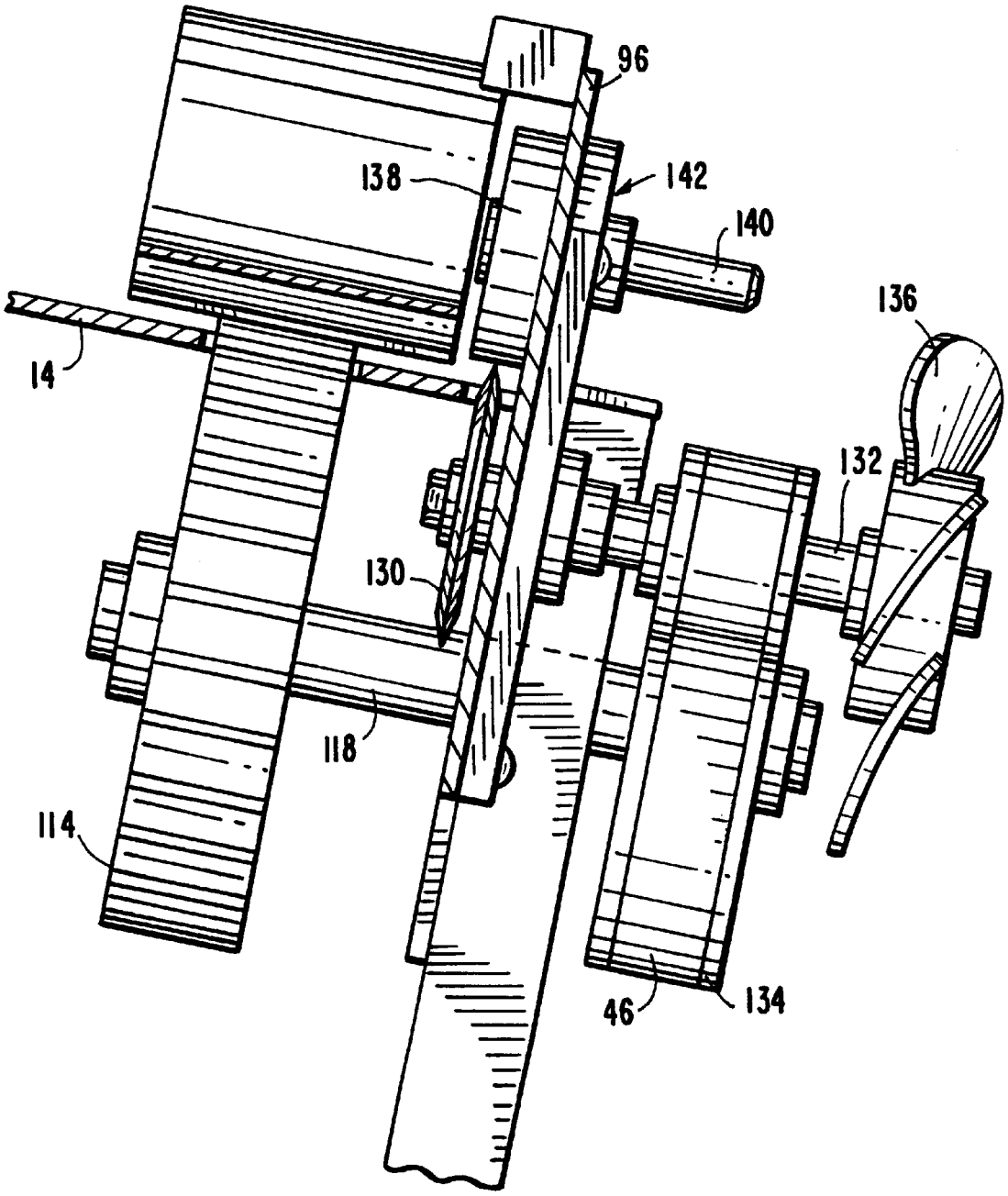
FIG. 4 is a cross-sectional view taken along lines 4—4 of FIG. 2, showing the precision chadless slitting mechanism.

As best seen in FIGS. 2 and 3 the device incorporates a unique dual independent suspension separator and alignment mechanism 18. It is the function of the separator-alignment mechanism to assure that only a single envelope passes beyond the zone 19 and also to assure that the marginal edge of the envelope is urged against and, hence, aligned with the guide plate 15.

The separator-alignment mechanism comprises a pair of feed tires 54–56, the upper peripheries of which extend slightly above the table 14 through cut-outs 58 and 60 respectively. Feed tires 54–56 are journaled on shaft 62 which extends into the rear of unit 10 and is coupled to pulley 64 and timing belt 46. The belt is driven by motor 42, independent pulley 66 and belt 68 drivingly coupled to shaft 70 of motor 42.

Optionally and preferably, the shaft 62 is angularly oriented relative to guide plate 15, i.e. the end 62*a* (FIG. 3) of shaft 62 is closer to the slitting zone 22 than the portion of the shaft adjacent plate 15 defining an included angle with fence or guide plate 15 of about 75 to 85 degrees. This inclination places the tire 54 slightly downstream of tire 56 (see FIG. 2), whereby envelopes driven by the tires are urged not merely in a forward or downstream direction but also laterally against the fence 15.

A fan 72 mounted on motor shaft 70 helps to cool the rear housing 74. The motor 42 is supported by a frame 76 to the lower housing wall 78 which may include rubber pads 80 to enable the unit to rest on an appropriate horizontal surface.

A flexible angled guide wall 81 attached to guide plate 24 is inclined downwardly to direct the envelope which is shifted downstream by feed tire 40 into the separating alignment zone 19. Contained within the upper hood 28 are a pair of separator stones 82 and 84. The stones are chosen for their durability and high coefficient of friction.

Without limitation and in compliance with the "best mode" requirements of the patent laws, it is noted that a suitable stone material is manufactured by the Norton Company of Wooster, Mass. and is generally described as an aluminum oxide in clay bond, the material normally being employed as a grinding wheel. Other substances possessing the properties of high friction and high wear resistance may be substituted.

The stones 82–84 include flat under surfaces 89 providing maximum surface area contact with the upper surface of an envelope 26 passing the separator station. The up stream ends, e.g., 82*a*, of the stones are arranged substantially perpendicular to the flat under surfaces to provide a positive block against feeding all but the envelope which is lowermost in the stack.

The stones 82–84 are mounted on lever arms 86–88 respectively via shafts 90 and 92. The arms 86 and 88 are in turn mounted on pivot shaft 94 affixed to support wall 96. The lever arms 86–88 are inclined such that the stones 82–84 are arrayed downstream of the pivot axis, such that an envelope passing between the drive wheels and stones will cause an anti-clockwise movement of the levers 86–88 as viewed in FIG. 2.

By providing separate high friction stones which are individually pivoted and laterally off-set, but arranged to co-act with drive wheels 54–56, it is made possible to feed envelopes which are not uniform in their context i.e. envelopes which bulge at one location and which are of lesser thickness at a second location. Additionally, the pivotable nature of the levers enables an automatic adjustment for envelopes of varying thickness. The levers or arms 86–88 are downwardly biased in a clockwise direction around shaft 94 by springs 100, 102, thereby applying a resistance sufficient to block an envelope engaging the upstream face of stones 82–84 while passing the lowermost envelope advanced from the infeed zone. Further, by angularly off-setting shaft 62 and tires 54 and 56 toward the guide fence or plate 15, the stones and tires 54–56 provide the additional function of laterally shifting any envelope which is not already aligned with its longitudinal edge against the guide fence or plate 15.

As previously noted, the angular orientation of the deck relative to guide fence or plate 15 augments the lateral shifting interaction between the feed, tires and stones to absolutely assure proper orientation of the envelopes moving downstream toward the cutter zone.

Envelopes guided through the separator-alignment zone 19 are advanced to the guide zone 20 by feed tire 114, the envelopes being pinched between the tire and a deflector guide 110. Preferably, the deflector guide 110 is comprised of a phosphor bronze material whereby the guide member is flexible and shape retaining. The deflector guide is mounted to wall 96 on bracket 112. The feed tire 114 protrudes through cutout 116 in deck plate or table 14. The tire 114 is journaled on shaft 118 extending through wall 96 and cooperates with the pulley 120 and timing belt 46 (FIG. 5) driven by motor 42.

The conjoint action of the deflector guide 110 and feed tire 114 assure the proper delivery of envelopes 26 to the chadless slitting zone 22. The slitting mechanism is preferably modular (i.e. an entire assembly may be substituted) and incorporates a circular cutting blade 130 mounted on shaft 132 and rotated by pulley 134 (FIG. 5) and timing belt 46.

A fan 136 may be mounted on shaft 132 to cool the interior of the rear housing 74.

Blade 130 and pressure roller 138 on adjustable shaft 140 are mounted on a support mechanism 142 for easy of replacement. The adjusting mechanism and cutter are preferably essentially as shown in U.S. Pat. No. 4,419,915, which is herein incorporated by reference, the mechanism allowing for adjusting the cutting depth via an eccentric internal cam (not shown) to achieve the precisely desired cutting depth.

As the slit envelope 26 leaves zone 22, it passes between an electric eye detector arrangement 144–146 which may be connected to a counter mechanism to provide a read out indicating a number of envelopes processed on the counter read-out 32.

A control module 148 may incorporate conventional operating components, i.e. to disconnect power in the event of a jamming.

Figure 5:
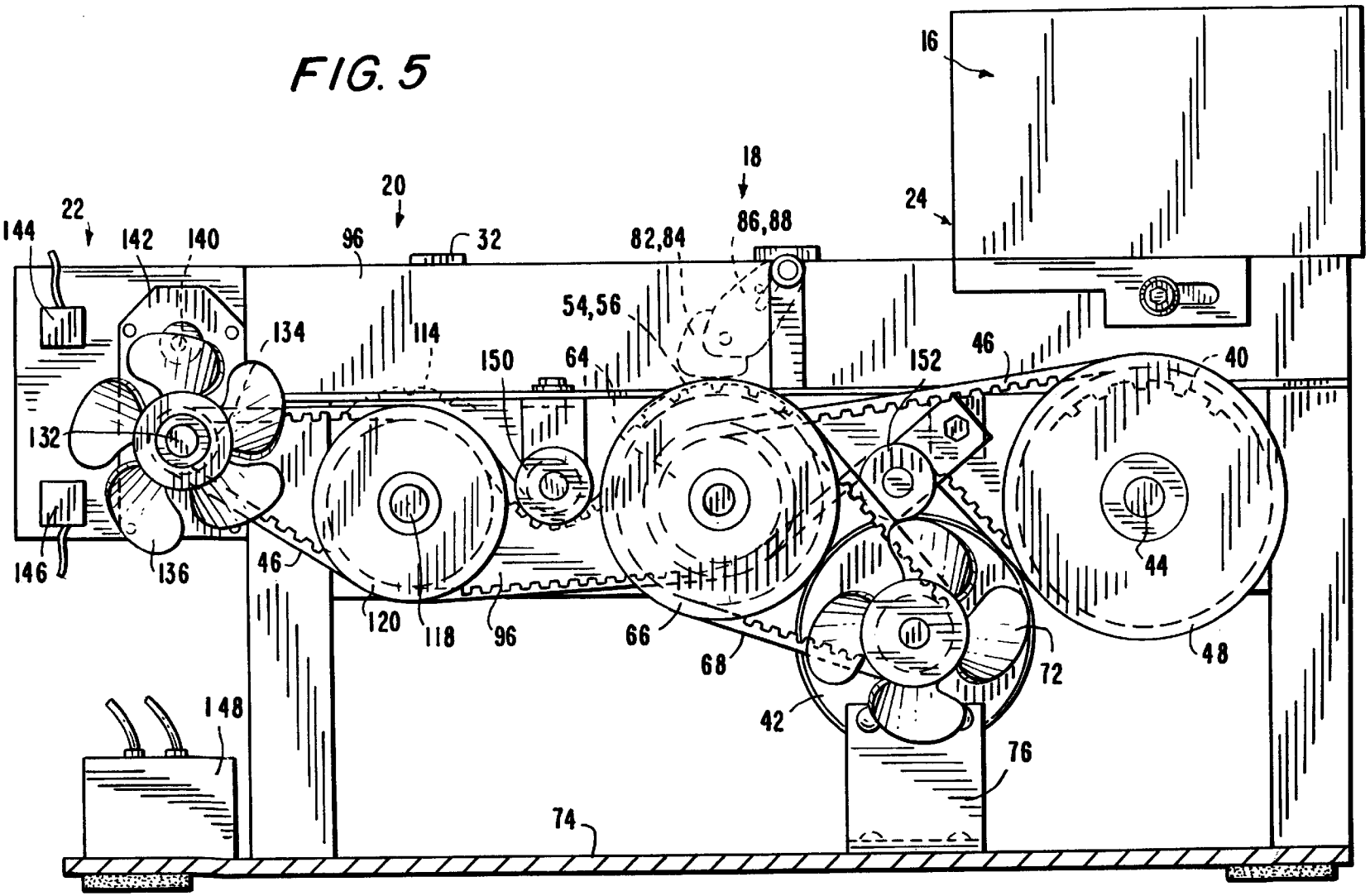
FIG. 5 is a rear elevational view showing the motor, belts and driving mechanisms.

As best seen in FIG. 5, appropriate tension in timing belt 46 is maintained by adjustment of tension pulleys 150–152.

Figure 6:
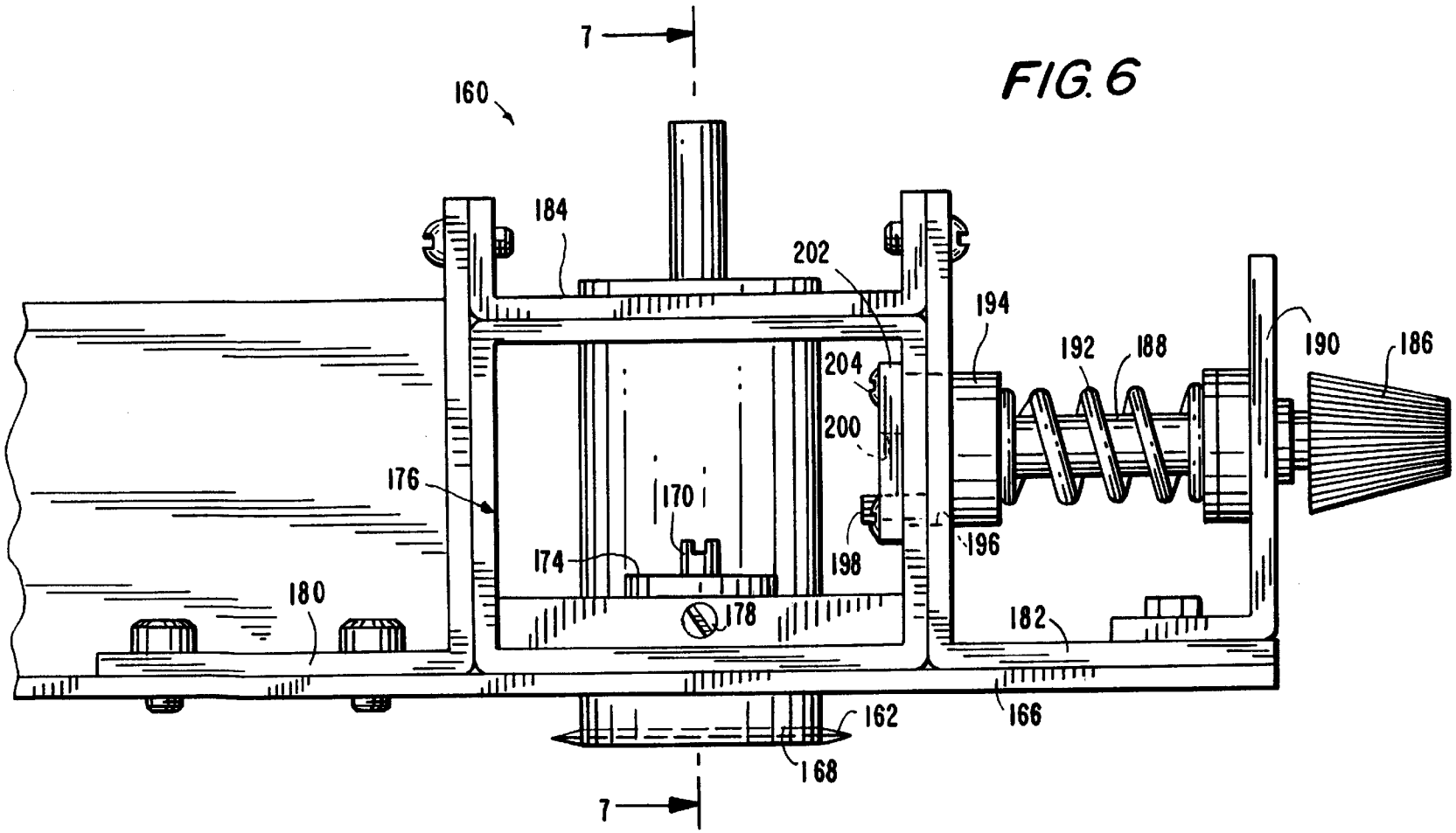
FIG. 6 is an enlarged fragmentary top plan view of an alternate modular adjustable slitting station.
Figure 7:
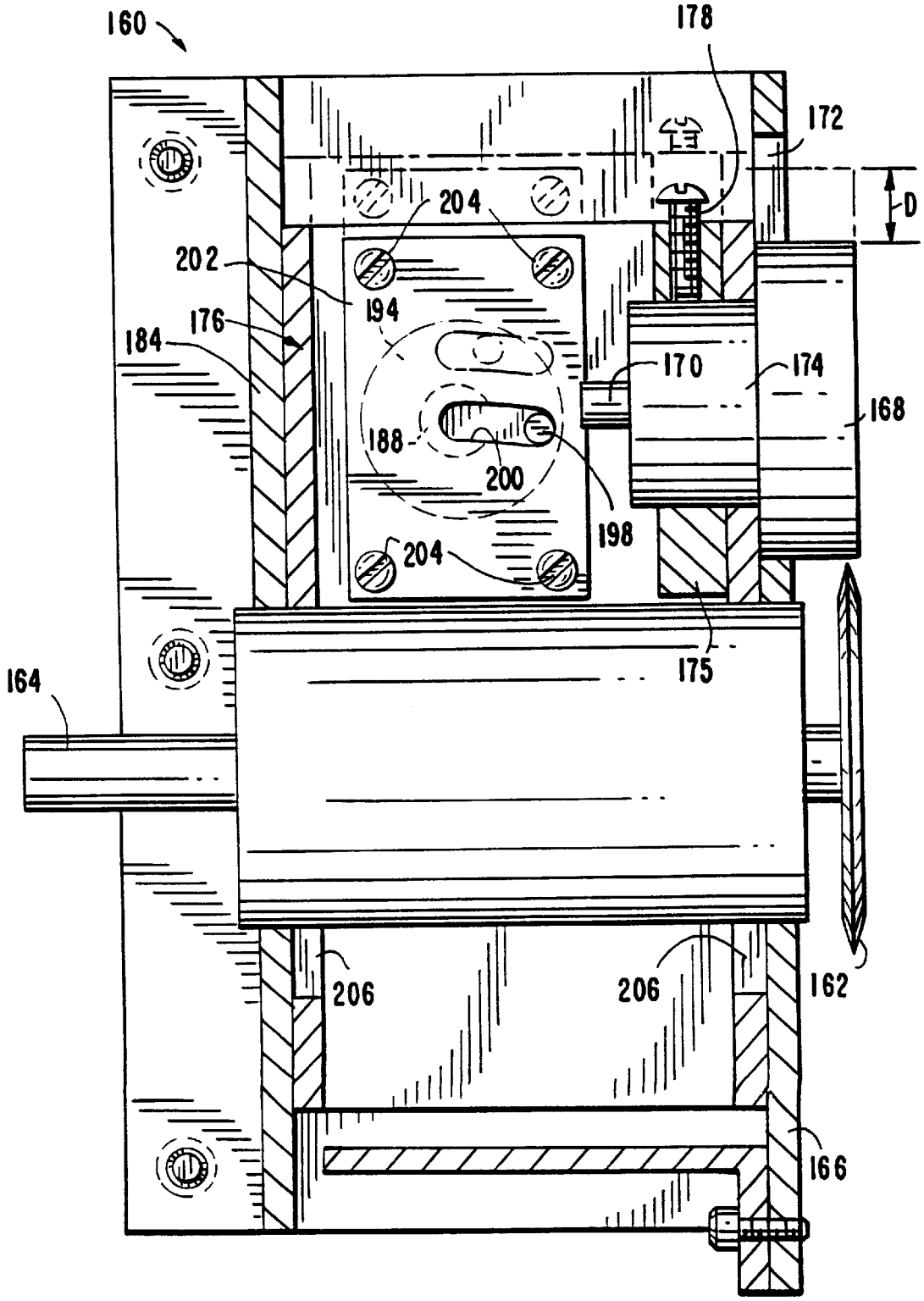
FIG. 7 is a cross-sectional view taken on the lines 7—7 of FIG. 6.

An alternative embodiment of cutting mechanism is disclosed in FIG. 6 and 7. This embodiment employs a replaceable blade and pressure roller mechanism 160. The mechanism 160 incorporates a fixed-in-position rotatable cutting blade 162 mounted on shaft 164 within housing 166. An adjustable pressure roller 168 is mounted on a shaft 170 and protrudes through opening 172 in housing wall 166. Mounted on shaft 170 behind pressure roller 168 is a hub 174. Hub 174 is mounted in a support plate 175 and held in place by set screw 178.

Support plate 175 is attached to a sliding cage 176. Housing wall 166 includes L-shaped brackets 180 and 182 attached thereto and with U-shaped bracket 184 affixed to brackets 180–182 (see FIG. 6) form a guideway for cage 176. The cage 176 is movable in a vertical direction, movement of the cage 176 being controlled by a adjustment knob 186. A shaft 188 made fast to the adjustment knob 186 passes through support bracket 190 attached to L-bracket 182. A spring 192 surrounds shaft 188 providing tension against accidental rotation of the shaft. Shaft 188 terminates in a hub 194, which is freely rotatable, in circular cut-out 196 of bracket 182. A camming pin 198 is attached to hub 194 and is trained within an arcuate camming slot 200 of cage plate 202. Cage plate 202 is mounted within cage 176 by screws 204.

When an especially thick package or series of packages is encountered requiring pressure roller 168 to raise a distance D, the knob 186 is rotated causing pin 198 in slot 200 to raise cage plate 202 and cage 176, as shown in phantom lines FIG. 7. This movement separates blade 162 a desired distance from roller 168, the vertical movement being accommodated by slots 206 in cage 176.

It will be appreciated that the alternative slitter mechanism shown in FIGS. 6 and 7 comprises a modular unit which may be separately installed within the mechanism and replaced as required.

As will be apparent from the preceding description there is disclosed in the present application an envelope slitter device characterized in that it provides a safe operating environment free from exposed elements such as belts which may injure a user or a users clothing. The device is capable of feeding from a nonuniform envelope stack without any adjustment for envelopes of varying sizes and thickness. The unique separator-alignment assembly eliminates the requirement of the envelopes in the stacking or infeed zone being accurately oriented against the guide fence or plate 15, since such orienting action is automatically effected by a combined separator and alignment mechanism.

The apparatus automatically accommodates envelopes of varying thickness and also envelopes which vary in thickness at various positions of or within the envelope.

As will be apparent to those skilled in the art and familiarized with the instant disclosure, numerous variations in details of construction may be effected without departing from the spirit of the invention.

Accordingly, the invention is to be broadly construed within the scope of the appended claims.

Having thus described the invention and illustrated its use, what is claimed as new and is desired to be secured by Letters Patent is:

1. In an automated feed chadless envelope slitter device for forming a longitudinally extending slit through one layer only of the lowest envelope of a stack of envelopes stacked at an infeed zone comprising an elongate planar support table having its longitudinal axis disposed in a generally horizontal plane, a guide fence extending upwardly from a side edge of said table, said table including infeed means at said infeed zone for advancing said lowermost envelope of said stack in a longitudinal direction along said table, separator-alignment means for receiving said lowermost envelope advanced by said infeed means and blocking all but said lowermost envelope from movement through said separator-alignment means and for shifting a margin of said lowermost envelope against said fence, slitter means adjacent said fence positioned to receive said lowermost envelope emerging from said separator-alignment means, said slitter means adapted to form a longitudinal slit through the lowermost layer only of said lowermost envelope proximate said envelope margin, the improvement which comprises said slitter means comprising a modular component removably mounted on said table, said separator-alignment means comprising a deflector surface inclined toward said table, a laterally spaced pair of drive tires downstream of said deflector surface, said tires rotating about a generally horizontal axis and including upper peripheral drive portions extending above said table, said peripheral portions moving in a downstream direction, a drag assembly disposed above each said peripheral portion, said drag assemblies each including a lever inclined in a downstream direction and having an upper end mounted for pivotal movement about a generally horizontal axis, a lower end, and a high friction drag member mounted on said lower end of said lever, said drag member including a generally vertically directed blocking surface on an upstream facing portion thereof and a generally horizontally disposed flat surface shiftable toward and away from said table at a position laterally offset from said peripheral portion of said drive tires.

2. In an automated feed chadless envelope slitter device for forming a longitudinally extending slit through one layer only of envelopes stacked at an infeed zone comprising an elongate planar support table having its longitudinal axis disposed in a generally horizontal plane, a guide fence extending upwardly from a side edge of said table, said table including means at said infeed zone for advancing the lowermost envelope of said stack in a longitudinal direction along said table, separator-alignment means for receiving said lowermost envelope advanced by said infeed means and blocking all but said lowermost envelope from movement through said separator-alignment means and for shifting a margin of said lowermost envelope against said fence and a modular slitter component removably mounted on said table adjacent said fence positioned to receive said lowermost envelope emerging from said separator-alignment means and forming a longitudinal slit through said lowermost envelope at a position proximate said envelope margin, said separator-alignment means comprising a deflector surface inclined toward said table, a laterally spaced pair of drive tires downstream of said deflector surface, said tires rotating about a generally horizontal axis and including upper peripheral drive portions extending above said table, said peripheral portions moving in a downstream direction, a drag assembly disposed above each said peripheral portion, said drag assemblies including a lever inclined in a downstream direction and having an upper-end mounted for pivotal movement about a generally horizontal axis and a lower end, a high friction drag member mounted on said lower ends of said levers, said drag members including a generally vertically directed blocking surface on an upstream facing portion thereof and a generally horizontally disposed flat surface shiftable toward and away from said table at a position laterally offset from said peripheral portions of said drive tires.

3. In an automated feed chadless envelope slitter device for forming a longitudinally extending slit through one layer only of the lowermost envelope of a stack of envelopes stacked at an infeed zone, said slitter comprising an elongate planar support table having its longitudinal axis disposed in a generally horizontal plane, a guide fence extending upwardly from a side edge of said table, said table including infeed means at said infeed zone for advancing said lowermost envelope of said stack in a longitudinal direction along said table, separator-alignment means for receiving said lowermost envelope advanced by said infeed means and blocking all but said lowermost envelope from movement through said separator alignment means and for shifting a margin of said lowermost envelope against said fence, slitter means adjacent said fence positioned to receive said lowermost envelope emerging from said separator-alignment means, said slitter means adapted to form a longitudinal slit through the lowermost layer only of said lowermost envelope at a position proximate said envelope margin, the improvement which comprises said separator-alignment means comprising a deflector surface inclined toward said table, a laterally spaced pair of said drive tires downstream of said deflector surface, said tires rotating about a generally horizontal axis inclined toward said fence and including upper peripheral drive portions extending above said table, said peripheral portions moving in a downstream direction, a drag assembly disposed above each said peripheral portion, said drag assemblies each including a lever inclined in a downstream direction and having an upper end mounted for pivotal movement about a generally horizontal axis, a lower end, and a high friction drag member mounted on said lower end of said lever, said drag member including a generally vertically directed blocking surface on a upstream facing portion thereof and a generally horizontally disposed flat surface shiftable toward and away from said table at a position laterally offset from and out of registry with said peripheral portions of said tires.

* * * * *